United States Patent [19]

Kaneko et al.

[11] Patent Number: 4,913,026

[45] Date of Patent: Apr. 3, 1990

[54] AUTOMATIC PLAYER PIANO WITH TOUCH STRENGTH ESTIMATOR

[75] Inventors: Yasutoshi Kaneko; Takasi Tamaki, both of Shizuoka, Japan

[73] Assignee: Yamaha Corporation, Hamamatsu, Japan

[21] Appl. No.: 302,381

[22] Filed: Jan. 27, 1989

[30] Foreign Application Priority Data

Jan. 29, 1988 [JP] Japan ..... 63-11860[U]
Mar. 22, 1988 [JP] Japan ..... 63-67835

[51] Int. Cl.[4] ..... G10F 1/02; G10G 3/04

[52] U.S. Cl. ..... 84/21; 84/115; 84/462; 84/DIG. 7

[58] Field of Search ..... 84/1.02–1.16, 84/1.18, 1.24, 1.27, 1.28, 19–23, 115, 462, DIG. 7, DIG. 29, 601, 602, 609–614, 626, 633–643

[56] References Cited

U.S. PATENT DOCUMENTS 4,307,648 12/1981 Stahnke .
4,351,221 9/1982 Starnes et al. .
4,450,749 5/1984 Stahnke .
4,593,592 6/1986 Stahnke ..... 84/21

*Primary Examiner*—Stanley J. Witkowski
*Attorney, Agent, or Firm*—Burns, Doane, Swecker & Mathis

[57] ABSTRACT

An automatic player piano is implemented with an automatic player unit and a mechanical piano having a keyboard mounted on a key bed, and the automatic player unit has a controller operative to memorizing pieces of a key touch information respectively representative of grades of intensity assigned to the sounds in the recording mode of operation and retrieve the pieces of the key touch information in the playback mode of operation, a plurality of actuators provided in association with the keyboard and responsive to the pieces of the key touch information for causing the keys to move, and a sensor unit operative to detect key motions of the keys for producing the pieces of the key touch information in the recording mode of operation, wherein the sensor unit is provided between the keyboard and the key bed because the space therebetween is largely equal regardless of the model of the mechanical piano.

11 Claims, 18 Drawing Sheets

PRIOR-ART

AUTOMATIC PLAYER PIANO WITH TOUCH STRENGTH ESTIMATOR

FIELD OF THE INVENTION

This invention relates to an automatic player piano and, more particularly, to an estimation of a strength of touch used for formation of a musical information in a recording mode of operation.

BACKGROUND OF THE INVENTION

In general, an automatic player piano is shifted between a recording mode of operation and a playback mode of operation. In the recording mode of operation, the keys are successively depressed by the fingers of a human player for specifying notes, and the pedals may be occasionally operated by the feet for prolonging the sounds, lessening the volumes or sustaining the notes. Since a lot of sensors are provided in association with the keys and the pedals, those key movements and pedal operations are detected to form pieces of the musical information which are memorized in a suitable storage. After formation of the pieces of the musical information, the automatic player piano is capable of shifting into the playback mode of operation. In the playback mode of operation, the pieces of the musical information are retrieved in succession from the storage for driving the keys and the pedals, if necessary, thereby allowing the automatic player piano to perform the music without the human player.

In an actual performance, each tone is loud or soft according to the strength of the key touch for an expressiveness, and, for this reason, the automatic player piano is provided with touch sensors for detecting the hammer velocities used for an estimation of the key touch. FIG. 1 shows a typical example of the automatic player piano provided with the touch sensors. In FIG. 1, reference numeral 1 designates a mechanical piano of the upright type which largely comprises a keyboard provided with a plurality of typically 88 keys, a key action mechanism provided in association with the keys for transmission of the key motions, a plurality of hammer assemblies respectively driven for rotations by the key action mechanism, a plurality of music wires struck with the hammer assemblies, respectively, and a plurality of damper assemblies respectively engageable with the music wires. Thus, the keys to the damper assemblies are incorporated in multiple, however, only one line of members, i.e., the key, the key action mechanism, the hammer assembly, the music wire and the damper assembly are illustrated in FIG. 1 and designated by reference numerals 2, 3, 4, 5 and 6, respectively. Though not shown in the drawings the mechanical piano 1 is further provided with a set of pedals. However, the mechanical piano of this type is well known in the art, so that no further description is incorporated.

The automatic player piano shown in FIG. 1 is accompanied with a controller 7 coupled at the input ports thereof to plural pairs of photo couplers and at the output ports thereof to a plurality of solenoid-operated actuators, and each pair of the photo couplers are spaced apart from each other along a traveling path of each hammer assembly, and optical paths of the photo couplers extend across the travel path, respectively. For the hammer assembly 4, the photo couplers 8 and 9 are located along the travel path thereof as will be seen from FIG. 1. By virtue of the multiple arrangement of the photo couplers 8 and 9, the motion of the hammer assembly 4 is detectable with the photo couplers, and the strength of the key touch is estimated on the basis of a time interval consumed between the interruptions of the optical paths of the photo couplers 8 and 9. In detail, if the human player depresses the key 2 with a large force, the large force is transmitted from the key 2 through the key action mechanism 3 to the hammer assembly 4, then allowing the hammer assembly 4 to rotate toward the music wire 5 at a large velocity. When the hammer assembly 4 is driven for rotation at the large velocity, the time interval is decreased in value, however, if the hammer rotates at a small velocity with a relatively small force, the time interval is prolonged. In general, the larger force the key 2 is subjected to, the shorter time interval the hammer assembly 4 consumes. Then, an inverse relationship is established between the force, or the key touch, and the velocity of the hammer assembly 4. In accordance with the inverse relationship, a piece of the key touch information is produced on the basis of the time interval calculated by the controller 7 and memorized therein.

The solenoid-operated actuators are provided in association with the keys and the pedals, respectively, and these solenoid-operated actuators are selectively energized by the controller 7 for actuations, thereby causing the keys and the pedals to be driven for selective movements, respectively. Then, if the piece of the key touch information is retrieved for the key 2 in the playback mode of operation, the solenoid-operated actuator 10 is energized with an electric power by the controller 7 to provide a power tantamount to that transmitted from the key 2 upon the original key depression. In this manner, the solenoid-operated actuators are selectively energized by the controller 7 to perform the music which was originally performed by the human player.

However, a problem is encountered in the prior-art automatic player piano in trammel of each photo coupler. As described hereinbefore, each hammer assembly is accompanied with a pair of photo couplers, so that the total number of the photo couplers is calculated as 88 multiplied by 2 or 176. These photo couplers should be precisely located at the respective positions, otherwise, the music produced in the playback mode of operation would be different from the original music. However, the precise trammel is not easy, because the hammers are different in size and in location depending upon the piano type, the model and the manufacturer and so on. In other words, the mechanical pianos have not been standardized yet. If each photo coupler is installed during the manufacturing process of the mechanical piano 1, the photo couplers may, make the manufacturing process to be a little bit complicated. However, the user occasionally requests the manufacturer to remodel the mechanical piano into an automatic player piano. This request provides a serious difficulty to the piano manufacturer, because the manufacturer hardly designs the photo couplers and the solenoid-operated actuators until the user's mechanical piano is checked by the manufacturer. After the user's mechanical piano is checked, the manufacturer can tailor the photo couplers and the actuators, so that a relatively long time period is consumed from the order for the remodeling to the completion of the work. This results in increasing of remodeling cost.

Moreover, the prior-art automatic player piano has another problem in stability of the production of the key touch information. This problem results from deformations of the component members which are usually made of wood, and a secular change in humidity due to heat attacks is causative of such a deformation. A large number of solenoid-operated actuators and the photo couplers are serious heat sources for the component members of wood. When the component members are deformed, the hammer velocity tends to be shifted, and, for this reason, the pieces of the key touch information do not indicate the original key touches during the service life of the automatic player piano.

SUMMARY OF THE INVENTION

It is therefore an important object of the present invention to provide an automatic player piano which is easy for remodeling.

It is also another important object of the present invention to provide an automatic player piano which is fit for use for a prolonged period of time with a credible stability.

To accomplish these objects, the present invention proposes to estimate the strength of a key touch on the basis of the key motion.

In accordance with one aspect of the present invention, there is provided an automatic player piano operable in a recording mode of operation and a playback mode of operation, comprising: (a) a mechanical piano having (a-1) a keyboard mounted on a key bed and provided with a plurality of keys respectively depressed with forces by a player, (a-2) a key action mechanism coupled to the keyboard for transmitting the forces exerted on the keys, (a-3) a hammer mechanism provided with a plurality of hammer assemblies, the hammer assemblies being coupled to the key action mechanism and driven for rotations with the forces transmitted by the key action mechanism, and (a-4) a plurality of music wires respectively struck with the hammer assemblies for producing sounds; and (b) an automatic player system having (b-1) a controller operative to memorize pieces of a key touch information respectively representative of grades of intensity assigned to the sounds in the recording mode of operation and retrieve the pieces of the key touch information in the playback mode of operation, (b-2) a plurality of actuators provided in association with the keyboard and responsive to the pieces of the key touch information for causing the keys to move, and (b-3) a sensor unit provided between the key bed and the keyboard and operative to detect key motions of the keys for producing the pieces of the key touch information in the recording mode of operation, in which each of the pieces of the key touch information is estimated on the basis of each of the key motions.

In accordance with another aspect of the present invention, there is provided a key touch estimation system provided in association with a mechanical piano having a keyboard provided with a plurality of keys respectively depressed with forces by a player, a key action mechanism coupled to the keyboard for transmitting the forces exerted on the keys, a hammer mechanism provided with a plurality of hammer assemblies, the hammer assemblies being coupled to the key action mechanism and driven for rotations with the forces transmitted by the key action mechanism, and a plurality of music wires respectively struck with the hammer assemblies for producing sounds, the key touch estimation system comprising (a) a controller operative to memorize pieces of key touch information respectively representative of grades of intensity assigned to the sounds in the recording mode of operation and retrieve the pieces of the key touch information in the playback mode of operation, (b) a plurality of actuators provided in association with the keyboard and responsive to the pieces of the key touch information for causing the keys to move, (c) a sensor unit provided in association with the keyboard and operative to detect key motions of the keys for producing the pieces of the key touch information in the recording mode of operation, (d) tracing means operative to produce loci of the key motions, (e) sampling means operative to extract sections for uniform motions from the loci, respectively, f) key velocity calculating means operative to decide key velocities in the sections, respectively, (g) final hammer velocity deciding means operative to estimate final velocities of the hammer assemblies on the basis of the key velocities, respectively, and (h) key touch information producing means operative to produce the pieces of the key touch information on the basis of the final velocities, respectively.

PRINCIPLE ON WHICH THE PRESENT INVENTION IS BASED

In the prior-art automatic player piano, the key touch is estimated on the basis of the hammer action or the time interval from the interruption detected by the photo coupler 8 and to interruption detected by the photo coupler 9. This is because of the fact that the grades of tone intensity are directly related to the hammer velocity. In other words, the key motion was considered not to be representative of the tone intensity, because the key is not fully depressed at all times. The human player sometimes repeats the partial depression from the nondepressed state to an intermediate state, which is sometimes referred to as "shallow touch", and, on the contrary, the key may be repeatedly depressed from the intermediate state to the fully depressed state. In this situation, the key touch can not be estimated from a time interval between fixed detecting points, because the maximum velocity is not always achieved between the fixed detecting points.

Efforts are made by the inventors for establishment of a relationship between the key touch and the key motion. Loci are plotted for various key operations as illustrated in FIGS. 2 to 5.

Plots A and B in FIG. 2 respectively represent the loci of the key produced upon the full key depressions in forte and in piano, and plots C and D are indicative of loci of the hammer corresponding to the key motions represented by the plots A and B, respectively. As will be understood from the plots A and B, the key is rapidly accelerated in a section a1 and, then, achieves a uniform motion in a section a2 after the forte keying-in operation, however, when the key is depressed in the piano touch, the key is gradually accelerated to achieve a uniform motion in a section b.

Plots E, F and G in FIG. 4 are indicative of the loci of the key produced upon a repetition, an extremely shallow touch and an usual shallow touch, respectively. Plots H, I and J are representative of loci of the hammer which are produced in the linkage of the key tracing the plots E to G, respectively. When the key is repeatedly depressed along the plots E, the key moves with the force of inertia in a section e1 and is, then, accelerated in a section e2, then achieving a uniform motion in a section e3. However, if the key is depressed in the extremely shallow manner, the key is rapidly accelerated in a section f1 and immediately achieves a uniform motion in a section f2. On the other hand, upon the usual shallow touch, the key is rapidly accelerated in a section g1 and, then, achieves a uniform motion in a section g2 followed by a section g3 for an inertia motion.

Thus, the key motions are different from one another depending upon the key touch, however, the inventors discover that key velocity in the uniform motion is related to the final hammer velocity as illustrated in FIG. 6. In FIG. 6, plots except for these encircled stand for the uniform motions in FIG. 2, respectively, and the encircled plots are indicative of the uniform motions in FIG. 4, respectively. As will be understood from FIG. 6, the plots are placed on a line K or in the vicinity of the line K, so that the final hammer velocity is related to the key velocity in the uniform motion regardless of the key touch. The final hammer velocity is directly proportional to the grade of intensity or loudness, and, for this reason, the key touch is capable of being estimated from the key velocity in the uniform motion.

BRIEF DESCRIPTION OF THE DRAWINGS

The features and advantages of an automatic player piano according to the present invention will be more clearly understood from the following description taken in conjunction with the accompanying drawings in which.

DESCRIPTION OF THE PREFERRED EMBODIMENTS

First embodiment

Speculative Description of Production of Key Touch Information

Figure 1:
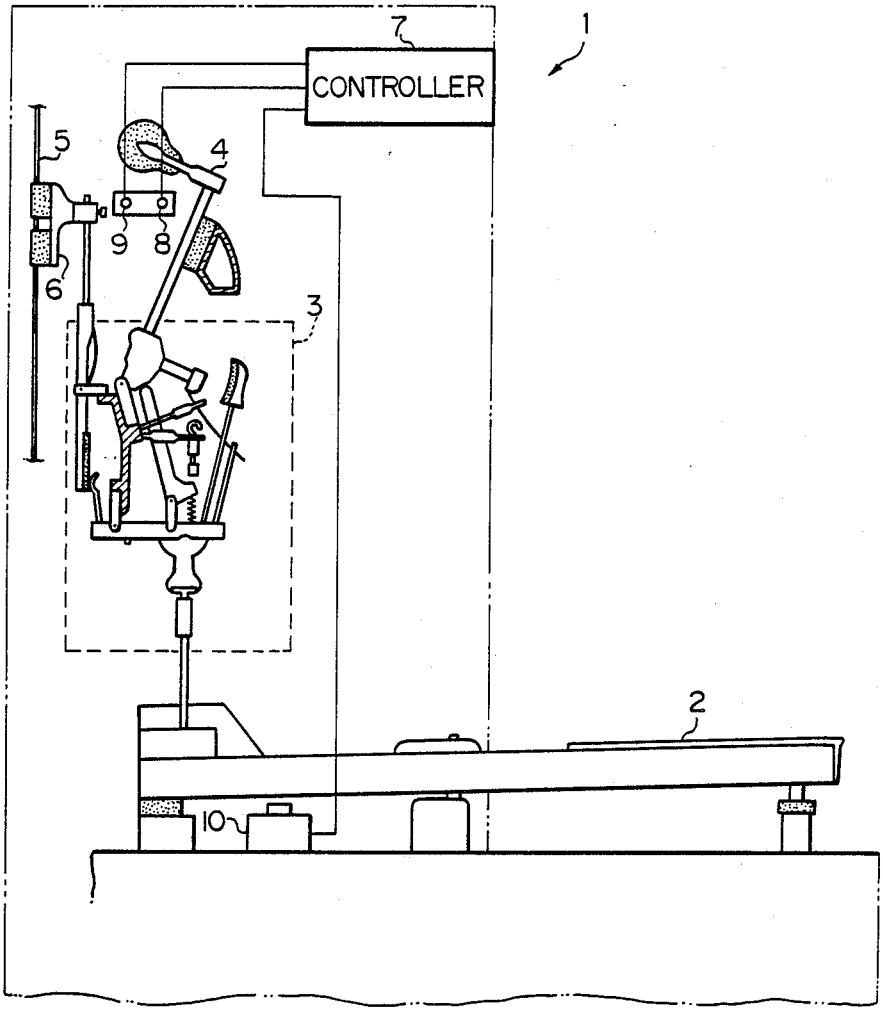
FIG. 1 is side view showing the structure of a typical automatic player piano.
Figure 2:
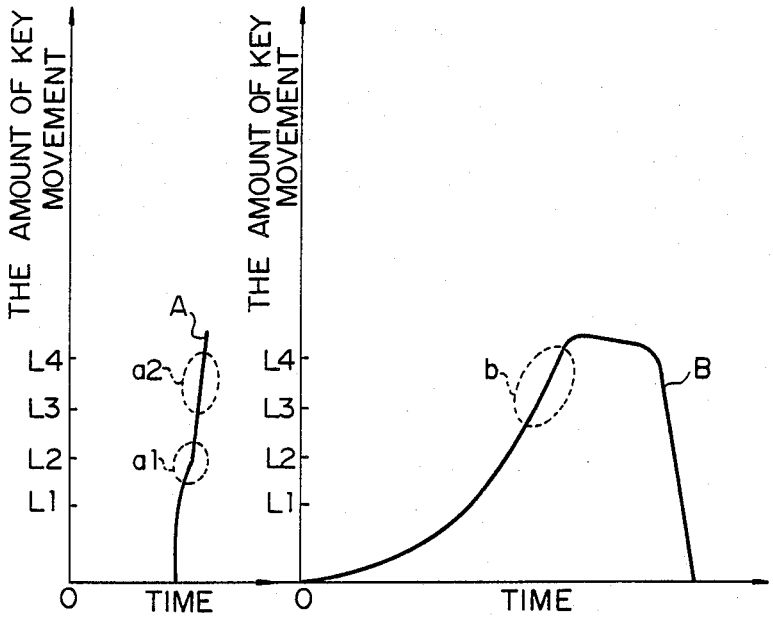
FIG. 2 is a graph showing loci of a key produced in the full depressions.
Figure 3:
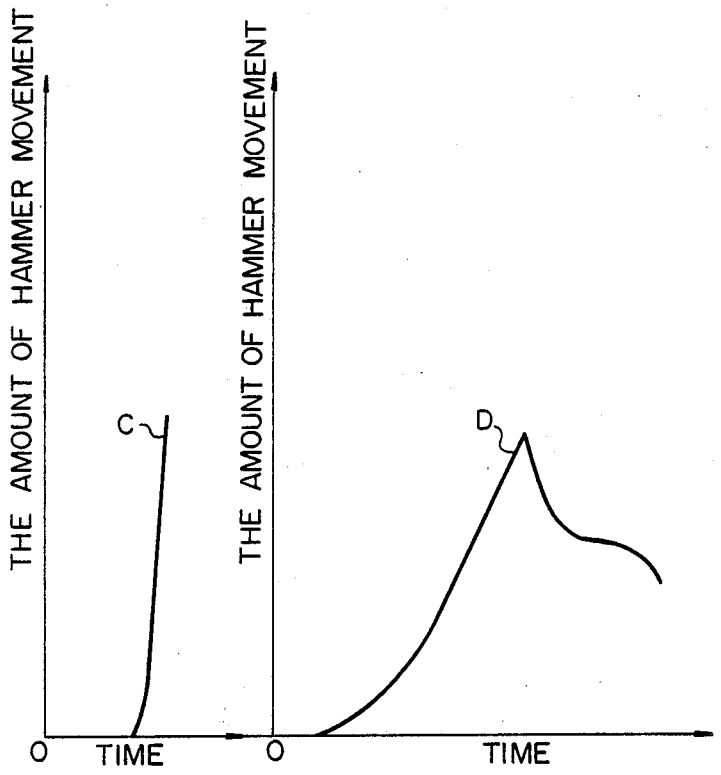
FIG. 3 is a graphic showing loci of a hammer linked with the key tracing the loci indicated in FIG. 2.
Figure 4:
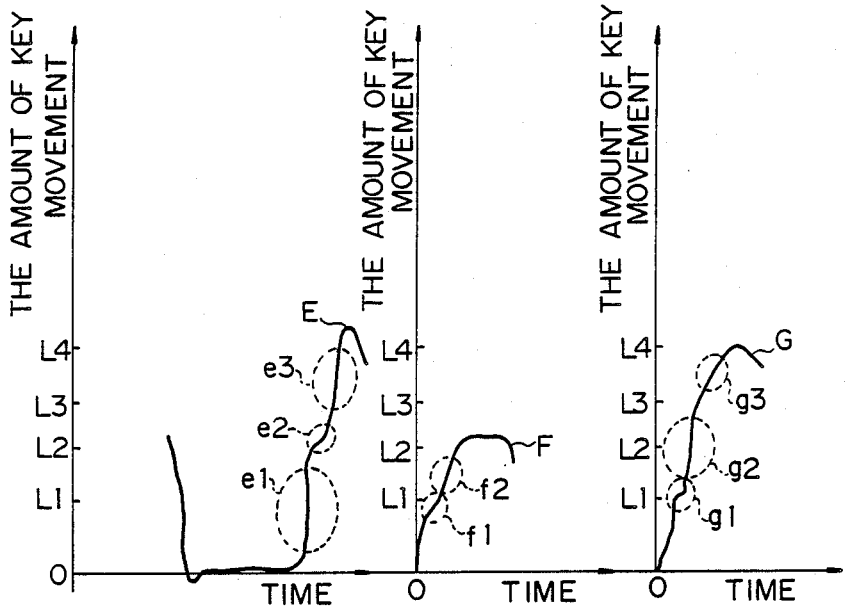
FIG. 4 is a graph showing loci of the key produced in repeated key depressions and shallow touches.
Figure 5:
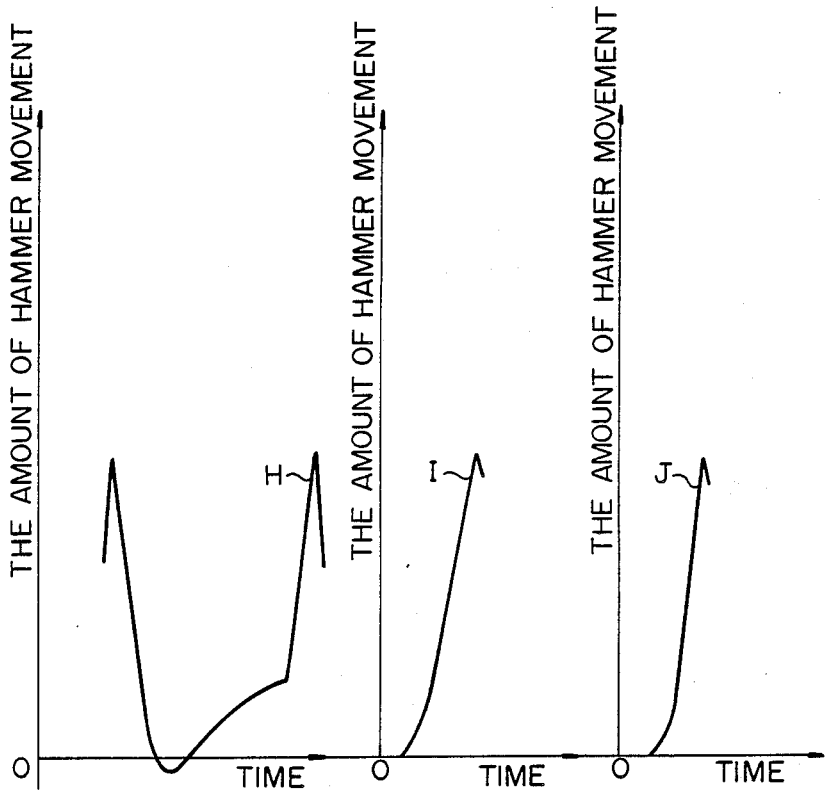
FIG. 5 is a graph showing loci of the hammer linked with the key tracing the loci indicated in FIG. 4.
Figure 6:
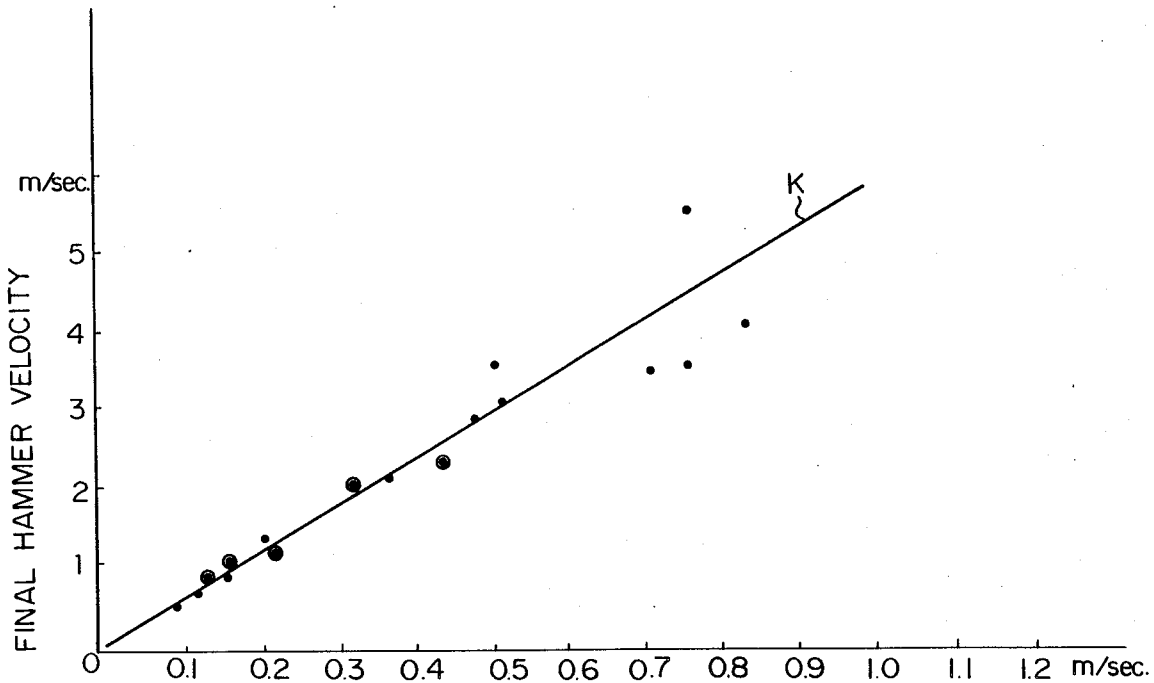
FIG. 6 is a graph showing the relationship between the key velocity in the uniform motion and the final hammer velocity.
Figure 7:
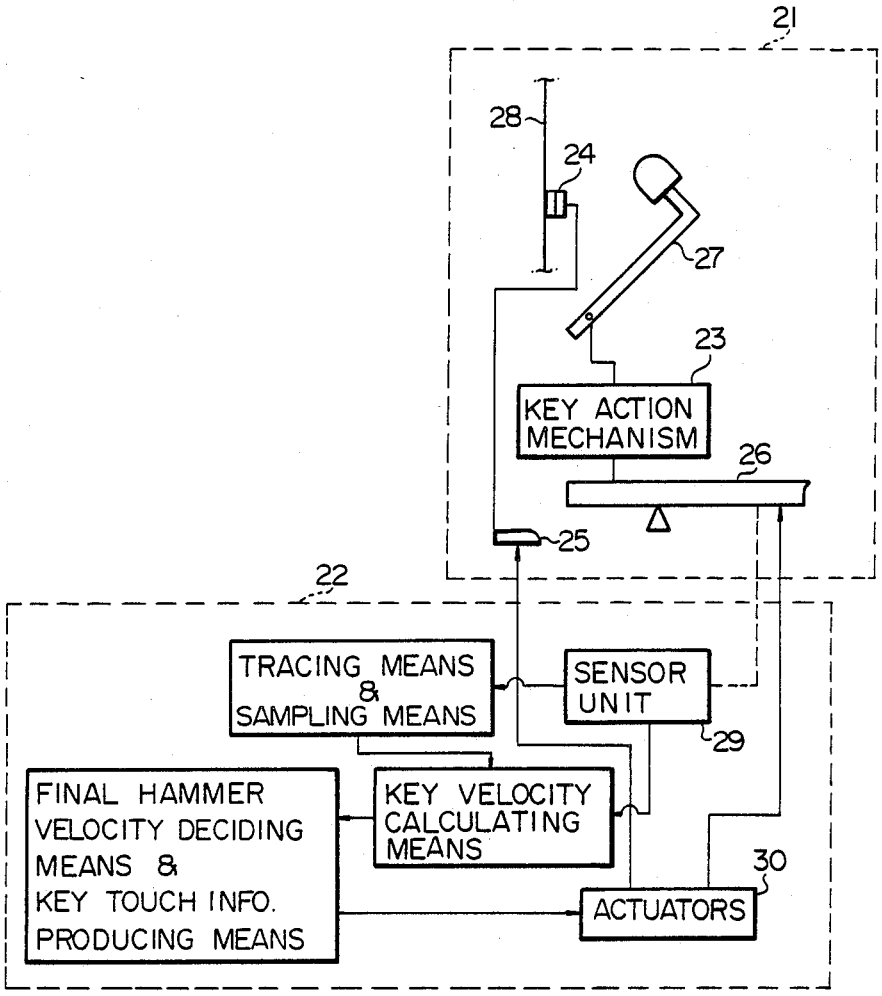
FIG. 7 is a block diagram showing, in a modeled form, the arrangement of a automatic player piano embodying the present invention.

Referring to FIG. 7 of the drawings, there is shown a general arrangement of an automatic player piano embodying the present invention. FIG. 7 is provided for focusing upon production of key touch information, and, for this reason, the other components omitted therefrom. The automatic player piano largely comprises a mechanical piano 21 and an automatic player system 22, and the mechanical piano 21 has a keyboard with a plurality of typically 88 keys, a key action mechanism 23 coupled to the keys, a plurality of hammer assemblies linked with the key action mechanism 23, a plurality of music wires capable of being struck with the hammer assemblies, respectively, and a damper mechanism 24 accompanied with a set of pedals 25. The mechanical piano 21 is thus provided with multiple mechanical lines, however, FIG. 7 shows only one mechanical line including the key 26, the hammer assembly 27 and the music wire 28 in a modeled form.

The automatic player system largely comprises a controller coupled at the input port thereof to a sensor unit 29 and at the output port thereof to a plurality of solenoid-operated actuators 30, and the controller achieves functions as tracing means, sampling means, key velocity calculating means, final hammer velocity deciding means and key touch information producing means.

The automatic player piano thus arranged is shifted between a recording mode of operation and a playback mode of operation. When a human player shifts the automatic player piano into the recording mode of operation and, then, begins to perform a music by successive keying-in operations, the keys are moved from undepressed states toward depressed states along respective traveling paths depending upon key touches, respectively. The forces exerted on the keys are transmitted through the key action mechanism 23 to the hammer assemblies, respectively. Then, the hammer assemblies are driven for rotations toward the music wires, and sounds are mechanically produced upon respective strikes. The key motions from the undepressed states toward the depressed states are respectively detected by the sensor unit 29 and the tracing means produce pieces of a locis information representative of loci of the key motions. After formation of the pieces of the locus information, the sampling means access the pieces of the locus information to extract sections for uniform motions from the loci, respectively. In the sections, the keys respectively travel in uniform motions. When the sections are respectively extracted from the loci of the key motions, the key velocity calculating means decide respective key velocities in the sections, and the final hammer velocity deciding means estimate respective final velocities of the hammer assemblies on the basis of the key velocities. The final hammer velocities are thus estimated from the key velocities, respectively, then the key touch information producing means produce the pieces of the key touch information each representative of the the intensity of the sound produced upon striking the music wires with the hammer assemblies. These pieces of the key touch information are memorized in the controller for a latter usage.

After memorizing the pieces of the key touch information into the controller, the automatic player piano is shifted into the playback mode of operation, then the controller retrieves the pieces of the key touch information in succession. The pieces of the key touch information are used for driving the solenoid-operated actuators 30, and, accordingly, the keys are moved with respective powers tantamount to those transmitted to the key action mechanism 23. Then, the hammer assemblies are driven for rotations toward the music wires, and the sounds are reproduced with the intensities equivalent to those of the original sounds.

Mechanical Arrangement of the Automatic Player Piano

Figure 8:
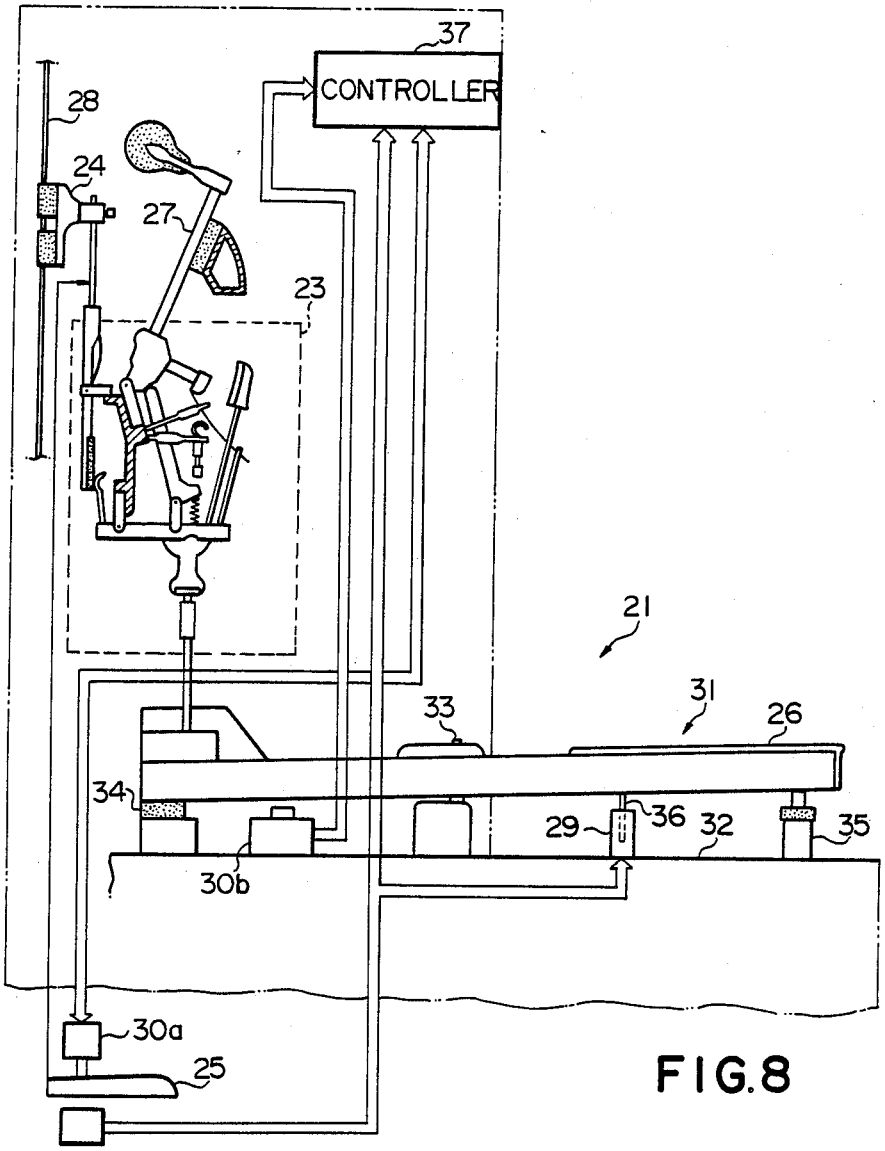
FIG. 8 is a side view showing the mechanical arrangement of the automatic player piano shown in FIG. 7.

Turning to FIG. 8 of the drawings, there is shown the mechanical arrangement of the automatic player piano illustrated in FIG. 7. The mechanical piano 21 is of the upright type, and the keyboard 31 including the key 26 is mounted on a key bed 32. Each of the keys is swingable with respect to a balance pin 33, however, the key motion is restricted by a back rail cloth member 34 and a front rail member 35. In this instance, the sensor unit 29 is provided on the key bed 32 between the front rail member 35 and the balance pin 33, and the solenoid-operated actuators 30 are mounted on the key bed 32 between the balance pin 33 and the back rail cloth member 34. Though not clearly shown in FIG. 8, the sensor unit 29 is provided with a plurality of photo couplers which are grouped by four and provided in association with the keys, respectively. Each of the keys are accompanied with a shutter plate 36 projecting from the lower surface of the key, and the shutter plate 36 is downwardly moved with the key, so that optical paths of the photo couplers are successively interrupted by the shutter plate 36, thereby detecting the locus of the key motion. Every four photo couplers are provided in association with every key, and the photo couplers grouped by four are referred to as "photo coupler group" in the following description. In each of the photo coupler groups, the four photo couplers are called as first, second, third and fourth photo couplers from the key side to the key bed side. The other mechanical components are well known in the art, and, for this reason, no further description is incorporated in the sake of simplicity.

Arrangement of Controller

On the upper front board of the mechanical piano is exposed the front panel of the controller 37 previously described with reference to FIG. 7.

Figure 9:
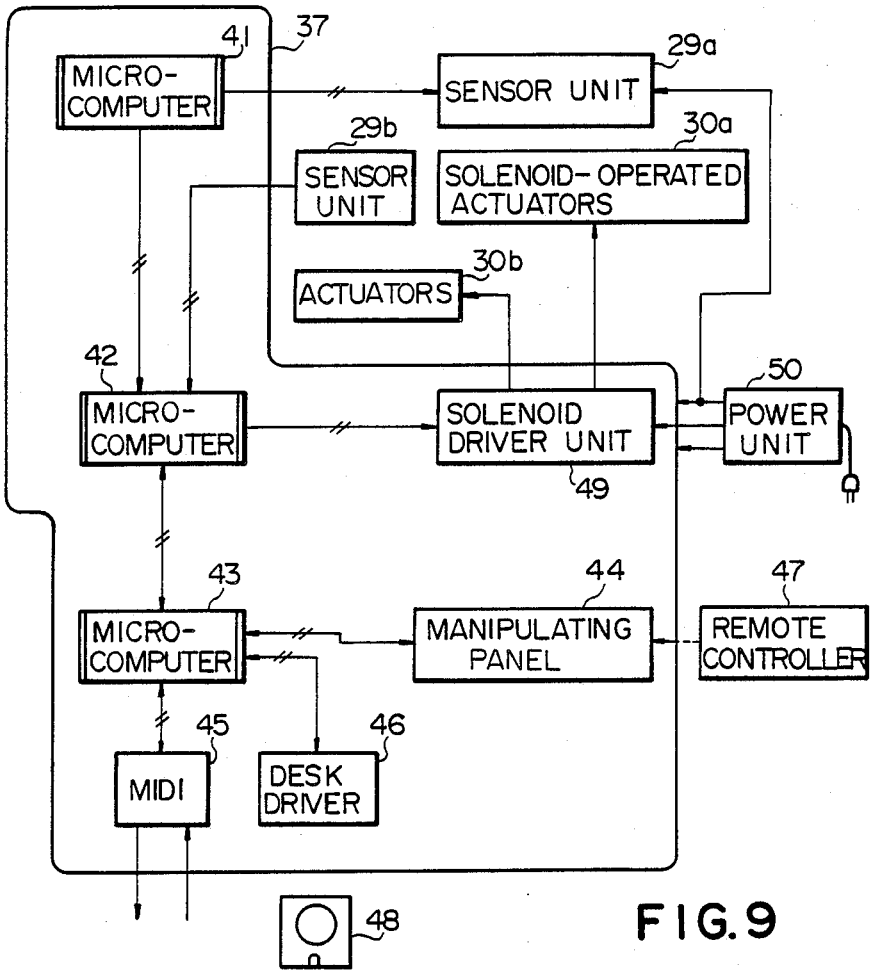
FIG. 9 is a block diagram showing the circuit arrangement of the controller incorporated in the automatic player piano shown in FIG. 7.

Turning to FIG. 9 of the drawings, the circuit arrangement of the controller 37 is illustrated and contains three micro-computer units 41, 42 and 43 which are of the single chip type. The micro-computer unit 41 is provided for scanning the sensor unit 29 and periodically checks the sensor unit **29*a* to see whether or not any photo coupler detects the key motion. When the sensor unit 29*a* detects the key motion, the micro-computer unit 41 produces a piece of the key touch information as well as a piece of a note information representative of a note assigned to the key depressed by the human player. On the other hand, the micro-computer unit 43 is dedicated to a manipulating panel 44, a MIDI unit 45 and a floppy disk driver unit 46. On the manipulating panel 44 are provided various kinds of switches such as, for example, a power switch, a volume switch, a mode selecting switch and so on, then the micro-computer unit 43 periodically checks the manipulating panel 44 to see whether or not any switch is operated. The manipulating panel 44 is accompanied with a remote controller 47, so that anyone can change the operation mode and the volume from a long distance. The floppy disk driver unit 46 is used for writing and reading out the pieces of the key touch information as well as the pieces of note information into and from a floppy disk 48. If the pedals 25 are operated by the human player, pieces of a pedal actuating information is also memorized into the floppy disk 48. The MIDI unit 45 is provided for a communication with another electronic musical instrument such as, for example, an autorhythmic system. However, the micro-computer unit 42 serves as a supervisor for the other computer units 41 and 43 and, accordingly, transfers the key touch information and the note information from the micro-computer unit 41 to the micro-computer unit 43. The micro-computer unit 42 is further operative to check into the sensor unit 29*b* associated with the pedals 25 for producing the pieces of the pedal actuating information which is also transferred to the micro-computer unit 43 for the storage. When the pieces of the information are retrieved from the floppy disk 48, the micro-computer unit 43 transfers the pieces of the information to the micro-computer unit 42 which in turn transfers them to a solenoid driver unit 49. The solenoid driver unit 49 is responsive to the pieces of the information and selectively distributes electric power supplied from the power unit 50, thereby causing the solenoid operated actuators 30*a* and 30*b* to be actuated. In order to produce the force tantamount to that originally transferred to the key action mechanism 23, the solenoid driver unit 49** changes the duty ratio of the electric power depending upon the piece of the key touch information.

Program Sequence

Figure 10:
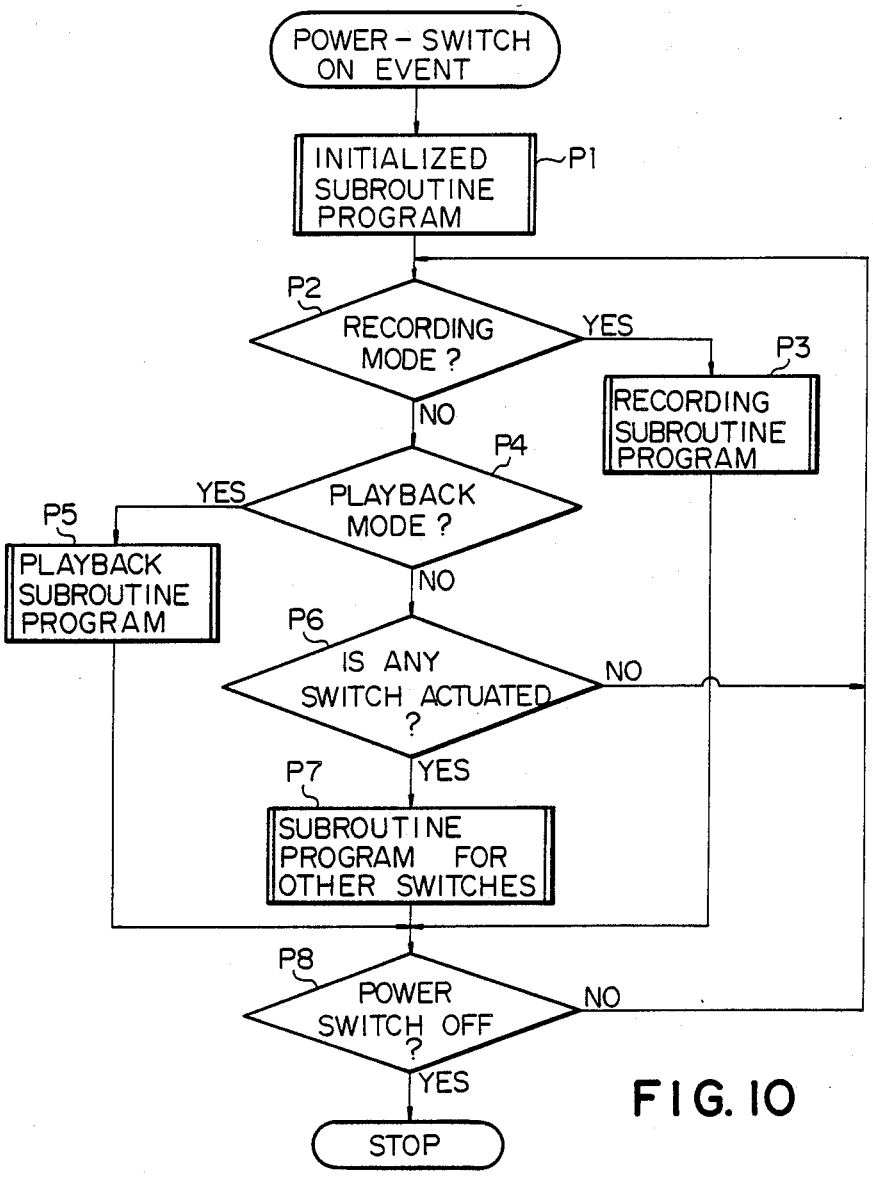
FIG. 10 is a flowchart showing the sequence of a mainroutine program executed by the controller shown in FIG. 9.

Turning to FIG. 10, description is made for a program sequence executed by the micro-computer units 41 to 43 of the controller 37. When the power switch turns on, the controller 37 immediately executes an initialized subroutine program P1. Upon completion of the initialized subroutine program, the controller 37 proceeds to step P2 and checks to see whether or not the mode selecting switch is shifted to the recording mode of operation. If the answer to the step P2 is given in the positive, the controller 37 is branched to a recording subroutine program P3 which will be described hereinafter in detail. However, if the answer to the step P2 is given in the negative, the controller 37 further checks to see whether or not the automatic player piano is shifted into the playback mode of operation as by step P4. If the controller 37 acknowledges the playback mode of operation, the answer to the step P4 is given in the positive, then the controller 37 is branched to a playback subroutine program P5 which is also described hereinafter in detail. However, when no operation mode is specified, the answer to the step P4 is given in the negative, then the controller 37 proceeds to step P6. In the step P6, the controller 37 checks to see whether or not any switches except for the mode selecting switch is operated. If the answer to the step P6 is given in the negative, the controller 37 returns to the step P2 and reiterates the loop consisting of the steps P2, P4 and P6 until the answer to any one of the steps P2, P4 and P6 is given in the positive.

When any one of the switches except for the mode selecting switch is operated, the answer to the step P6 is given in the positive, then the controller 37 is branched to a subroutine program for the other switches P7. Whenever any one of the subroutine programs P3, P5 and P7 are completed, the controller 37 proceeds to step P8 to see whether or not the power switch turns off. The answer to the step P8 is given in the negative in so far as the electric power is supplied from the source 50, then the controller 37 returns to the step P2 and reiterates the loop consisting of the step P2 to P8 until the power switch turns off.

Figure 11A:
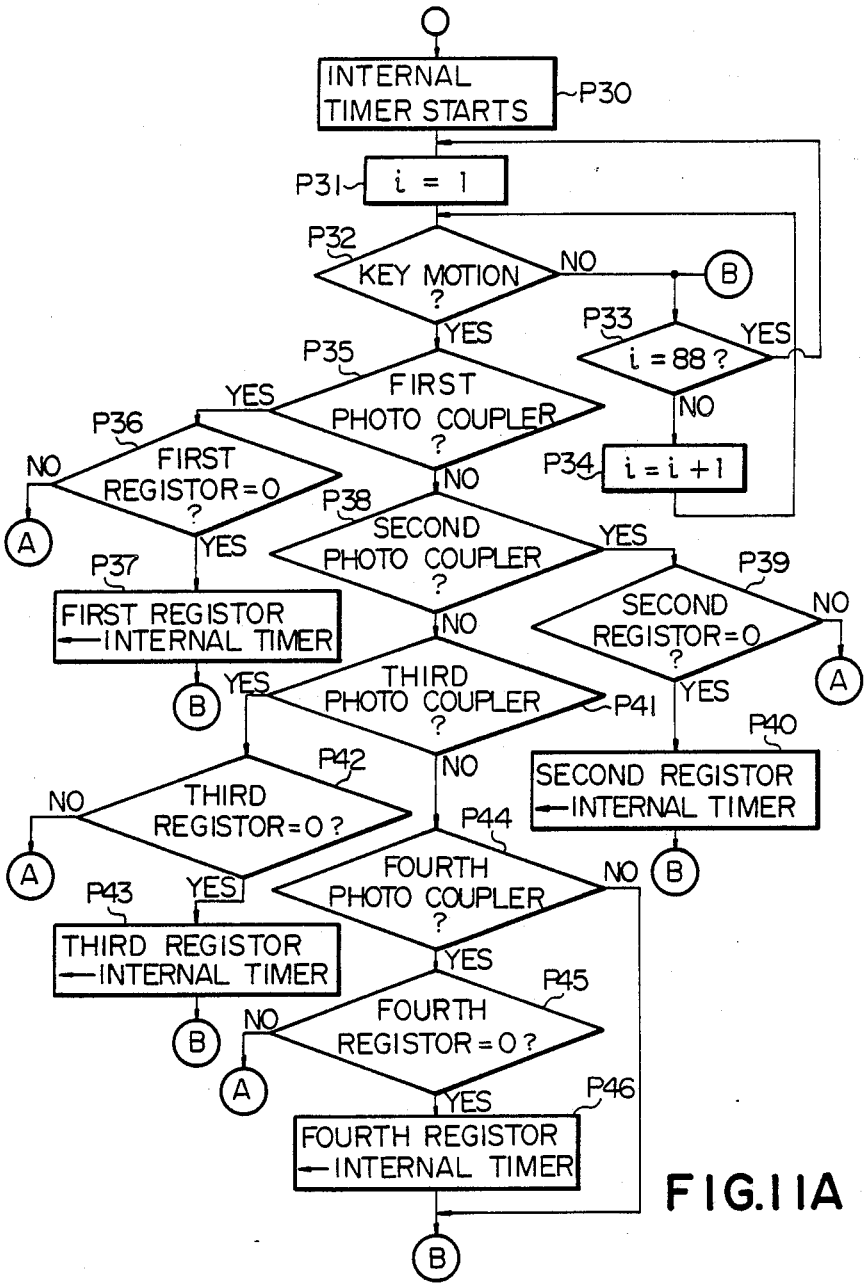
FIGS. 11A and 11B are flowcharts showing the sequence of a recording subroutine program executed by a micro-computer unit incorporated in the controller.
Figure 11B:
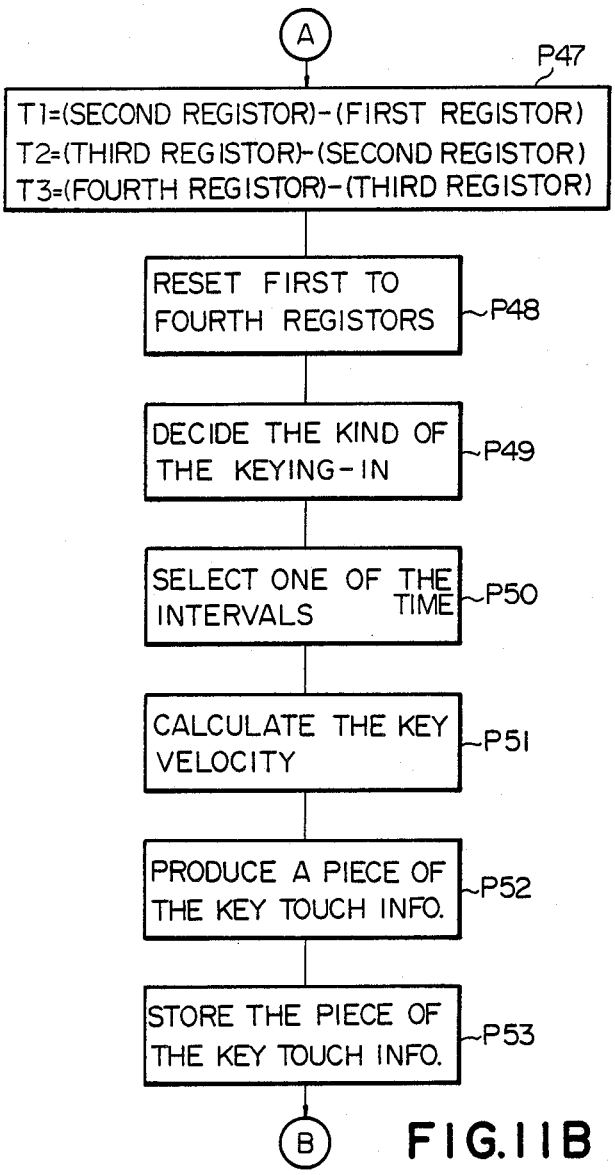

As described above, when the mode selecting switch is shifted to the recording mode of operation, the answer to the step P2 is given in the positive, then the controller 37 is branched to the recording subroutine program P3. The program sequence of the recording mode of operation is illustrated in FIGS. 11A and 11B and starts with step P30 where an internal timer of the micro-computer unit 41 begins to count clock pulses. Then, the micro-computer unit 41 writes value "1" into an index register i as by step P31 and, thereafter, checks to see whether or not the photo coupler group associated with the first key detects the key motion as by step P32. Prior to a first keying-in operation, no photo coupler group detects any key motion, so that the answer to the step P32 is given in the negative, then allowing the microcomputer unit 41 to proceed to step P33. In the step P33, the micro-computer unit 41 checks to see whether or not the index register i has been increased to value "88". The index register i is provided for specifying the position of the key currently checked, so that the answer to the step P33 is given in the negative before all of the eighty-eight keys are checked. In this situation, the micro-computer unit 41 proceeds to step P34 to increment the index register i. Upon completion of the step P34, the micro-computer unit 41 returns to the step P32 to check to whether or not the photo coupler group specified by the index register i detects the key motion. The micro-computer unit 41 thus reiterates the loop consisting of the steps P31 to P34 until the answer to the decision step P32 is given in the positive. However, when all of the photo coupler groups are checked by the micro-computer unit 41, the index register i maintains value "88", then the answer to the decision step P33 is given in the positive. With the positive answer for the decision step P33, the micro-computer unit 41 returns to the step P31 to rewrite value "1" into the index register i again and, then, reiterates the loop consisting of the steps P32 to P34 to find the key depressed by the player.

When a performance of a music starts with a first keying-in operation followed by a series of keying-in operations, the answer to the decision step P32 is given in the positive under the index register i matched with the key position subjected to the first keying-in operation. Then, the micro-computer unit 41 proceeds to step P35 and checks to see whether or not the key motion is detected by the first photo coupler. Any key motion is firstly detected by the first photo coupler, so that the answer to the decision step P35 is given in the positive immediately after a fresh keying-in operation. If it is found that the key motion is detected by the first photo coupler, the micro-computer unit 41 proceeds to step P36 and checks to see whether or not a first register assigned the first photo coupler keeps value "0". When the key is moved from the undepressed state toward the depressed state, the first register stores value "0". Then, it is found that the first register keeps value "0", the answer to the decision step P36 is given in the positive, and the microcomputer unit 41 proceeds to step 37 and transfer the counting value of the internal timer to the first register. After the step P37, the micro-computer unit 41 returns to the step P33 to continue the detecting operation.

When the shutter plate 36 interrupts the optical path of the second photo coupler, the answer to the decision step P32 is given in the positive, however, the answer to the decision step P35 is given in the negative. Then, the micro-computer unit 41 proceeds to step P38 and checks to see whether or not the key motion is detected by the second photo coupler. After the detection by the first photo coupler, the key motion is usually detected by the second photo coupler. Then, it is found that the answer to the decision step P 38 is given in the positive. With the positive answer to the decision step P38, the micro-computer proceeds to step P39 to see whether or not a second register assigned the second photo coupler keeps value "0". On the way to the depressed state, the second register also keeps value "0". Then, it is found that the second register keeps value "0", and the answer to the decision step P39 is given in the positive, then the micro-computer unit 41 transfers the counting value of the internal timer to the second register as by step P40. After the completion of the step P40, the micro-computer unit 41 returns to the step P33 so as to continue the detecting operation.

With a lapse of time, the shutter plate 36 interrupts the optical path of the photo coupler again, so that the answer to the decision step P32 is given in the positive, however, the answers to the decision steps P35 and P38 are given in the negative. Then, the micro-computer unit 41 proceeds to step P41 to see whether or not the key motion is detected by the third photo coupler. After the interruption of the optical path of the second photo coupler, the shutter plate 36 usually interrupts the third photo coupler. Then, it is found that the answer to the decision step P41 is given in the positive, and the micro-computer unit 41 checks into a third register assigned to the third photo coupler to see whether or not value "0" is stored in the third register as by step P42. Since the third register keeps value "0" upon the depression of the key, it is found that the third register keeps value "0", and the micro-computer unit 41 transfers the counting value of the internal timer to the third register as by step P43, then returning to the step P33.

After a while, the shutter plate 36 interrupts the optical path of the photo coupler again, so that the answer to the decision step P32 is given in the positive, however, the answers to the decision steps P35, P38 and P41 are given in the negative. Then, the micro-computer unit 41 proceeds to step P44 to see whether or not the key motion is detected by the fourth photo coupler. After the interruption of the optical path of the third photo coupler, the shutter plate 36 usually interrupts the fourth photo coupler. Then, it is found that the answer to the decision step P44 is given in the positive, and the micro-computer unit 41 checks into a fourth register assigned to the fourth photo coupler to see whether or not value "0" is stored in the fourth register as by step P45. The fourth register has been reset to value "0", so that it is found that the fourth register keeps value "0", and the micro-computer unit 41 transfers the counting value of the internal timer to the fourth register as by step P46, then returning to the step P33.

In this manner, the counting values are successively stored in the first to fourth registers when the key is fully depressed, however, if the key is partially depressed in the shallow touch, the key motion may not be detected by the fourth photo coupler. In any case, the registers store the respective counting values which are indicative of the locus of the key motion. For this reason, the tracing means are achieved by the steps P30 to P46.

When the key is released, the key is moved toward the undepressed state, and the shutter plate 36 interrupts the optical path of the photo coupler again. Then, the answer to the decision step 32 is given in the positive, and any one of the decision steps P35, P38, P41 and P44 is given in the positive. Then, the micro-computer unit 41 proceeds to step P47 and calculates time intervals T1, T2 and T3 between the first and second photo couplers, between the second and third photo couplers and between the third and fourth photo couplers, respectively. After the calculation, the micro-computer 41 proceeds to step P48 and resets the first and second registers for the subsequent keying-in operation. The micro-computer unit 41 compares the time intervals T1 to T3 with an internal table ( not shown ) to decide the kind of the keying-in operation as by step P49 and, then, selects one of the time intervals depending upon the kind of the keying-in operation decided on the basis of the time intervals as by step P50. The selected time interval stands for the section where the key moves in the uniform motion. Then, the steps P47 to P50 as a whole achieve the function of the sampling means.

When the time interval is selected, the micro-computer unit 41 decides the key velocity on the basis of the selected time interval as by step P51. Then, the key velocity calculating means are achieved by the step P51. When the key velocity is decided, the micro-computer unit 41 estimates the final hammer velocity and, then, produces a piece of the key touch information as by step P52. Then, the final hammer velocity deciding means as well as the key touch information producing means are achieved by the step P52. Thus, the piece of the key touch information is produced by the micro-computer unit 41, then the piece of the key touch information is transferred to the micro-computer unit 43 which in turn transfers the piece of the key touch information to the floppy disk driver unit 46 for storing into the floppy disk 48 as by step P53. If the piece of the key touch information is thus memorized into the floppy disk 48, the micro-computer unit 41 returns to the step P33 for the subsequent keying-in operation. In this way, the micro-computer unit 41 repeats the loop consisting of the steps P30 to P53 until the automatic player piano is escaped from the recording mode of operation. Additionally, the detecting operation will be masked from the completion of the step P48 to the return to the undepressed state.

In the program sequence described above, all of the time intervals are calculated in the step P47, however, some kinds of the keying-in operation tends to be characterized by only one time interval. For this reason, the micro-computer unit 41 may calculate the time interval T1 after the step P40 and check to see if or not the time interval T1 features the keying-in operation. If the kind of the keying-in operation is decided from the time interval only, no calculation is carried out for the time intervals T2 and T3. If not, the subsequent time interval is calculated. Thus, the time intervals are sequentially calculated from one to another, the micro-computer unit 41 will be certainly decreased in the amount of job.

As described in connection with the problem of the prior-art, some users request the piano manufacturer to remodel the mechanical piano into an automatic player piano. The component members are not standardized, however, the space between the keyboard and the key bed are substantially identical with one another. Then, it is preferable to accommodate the sensor units and the actuators in the space in view of the standardization.

Second embodiment

Figure 12:
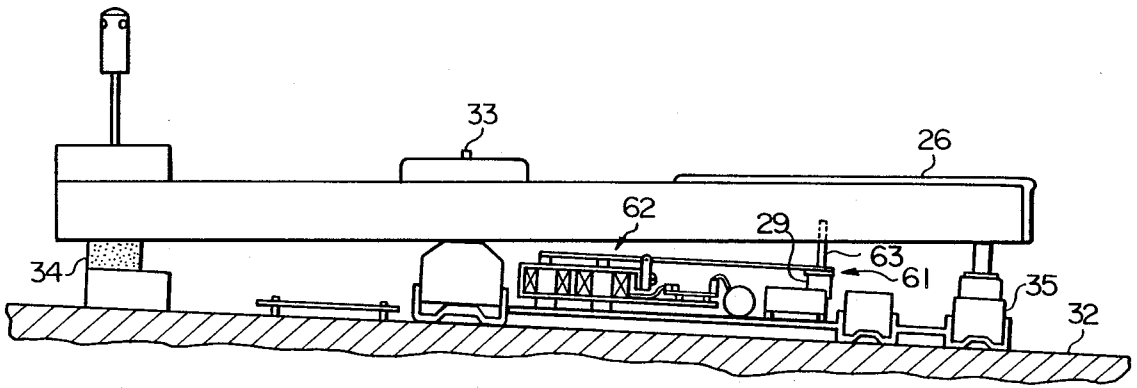
FIG. 12 is a side view showing the arrangement of a part of another automatic player piano embodying the present invention.

Turning to FIG. 12 of the drawings, there is shown the arrangement of a part of an automatic player piano embodying the present invention. The automatic player piano partially illustrated in FIG. 12 is similar in arrangement to the automatic player piano illustrated in FIG. 8 except for a sensor unit 61 and solenoid-operated actuators 62, so that description is focused upon the sensor unit 61 and the solenoid-operated actuators 62, and the other component members are denoted by like reference numerals designating the corresponding component members of the automatic player piano illustrated in FIG. 8.

Figure 13:
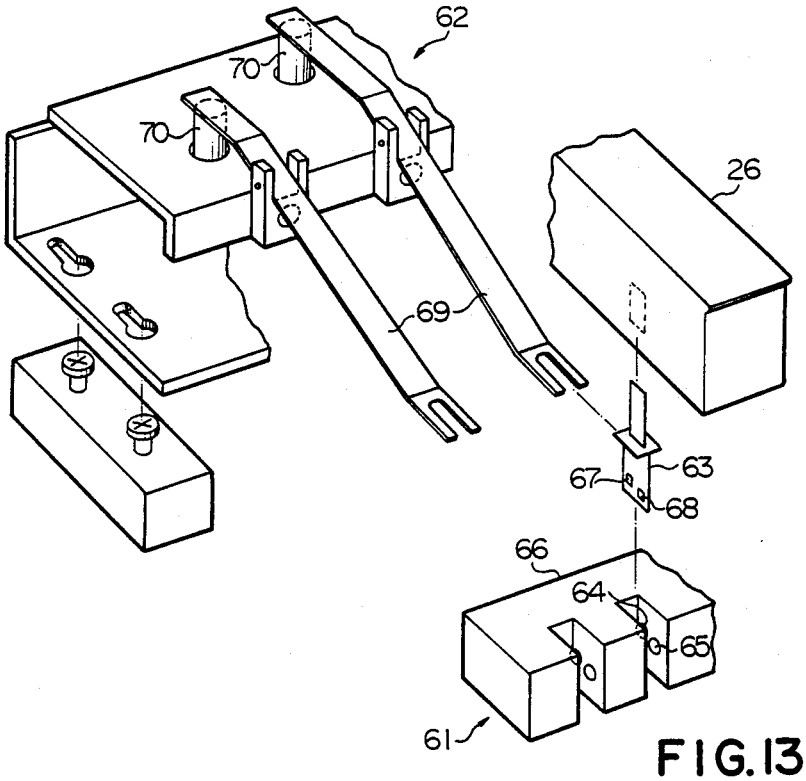
FIG. 13 is a perspective view showing, in a disassembled state, the arrangement of a sensor unit incorporated in the automatic player piano partially shown in FIG. 12.
Figure 14:
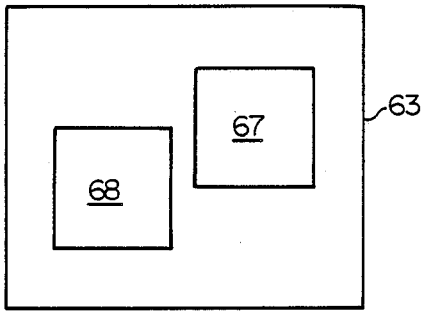
FIG. 14 is a plan view showing an encoder plate incorporated in the sensor unit shown in FIG. 13.

As illustrated in detail in FIG. 13, the sensor unit 61 largely comprises an encoder plate 63 and two photo couplers 64 and 65 supported by a bracket member 66. Two small windows 67 and 68 are formed in the encoder plate 63 in such a manner that optical paths of the photo couplers 64 and 65 intermittingly pass the windows 67 and 68, respectively, while the key 26 is moved toward the depressed state. In this instance, each of the windows is about 0.5 millimeter in height. Since the windows 67 and 68 are slightly deviated from each other as seen from FIG. 14, the optical path of the photo coupler 65 firstly extends through the window 68 on the way to the depressed state, and, then, both of the optical paths are established through the windows 68 and 67 for the photo couplers 65 and 64. If the key 26 is further moved, the optical path of the photo coupler 65 is blocked by the encoder plate 63, but the optical path of the photo coupler 64 still extends through the window 67. However, if the key 26 is further advanced, both of the optical paths are blocked by the encoder plate 63. Thus, the sensor unit 61 is capable of producing four bit patterns or a two bits of an encoded signal, which is summarized in the following table, with only two photo couplers. This results in reduction in the production cost. In the sensor unit 61 shown in FIG. 13, the photo couplers 64 and 65 are arranged in juxtaposition, but the windows are slightly deviated from each other. However, the photo couplers may be arranged in a deviated manner with the juxtaposed windows in another implementation.

TABLE

| | Optical path of Photo Coupler 64 | Optical path of Photo Coupler 65 |
|---|---|---|
| First Position | Blocked | Established |
| Second Position | Established | Established |

TABLE-continued

| | Optical path of Photo Coupler 64 | Optical path of Photo Coupler 65 |
|---|---|---|
| Third Position | Established | Blocked |
| Fourth Position | Blocked | Blocked |

If the two bits of the encoded signal is supplied to the controller, the controller can trace the locus of the key motion on the basis of the four bit patterns. For this reason, the micro-computer unit 41 periodically checks to see whether or not the bit patter is varied for making decisions instead of the steps p35, P38, P41 and P44.

The solenoid-operated actuators 62 are supported by a bracket member and accompanied with lever members 69, respectively. Each of the lever members 69 is rotatably supported at an intermediate portion thereof by the bracket member and engaged at the rear end portion thereof with a plunger 70. The plunger 70 passes through a solenoid, so that the plunger 70 is projectable from the bracket member. The lever member 69 is engaged at the front end portion thereof with the shutter plate 36, and, for this reason, the key 26 is pulled down upon the projection of the plunger 70.

Third embodiment

Figure 15:
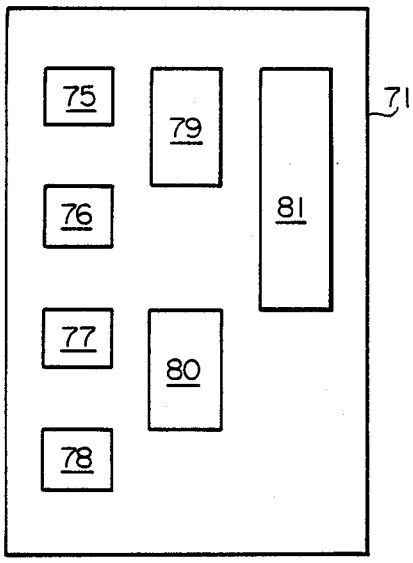
FIG. 15 is a plan view showing another encoder plate incorporated in still another automatic player piano embodying the present invention.
Figure 16:
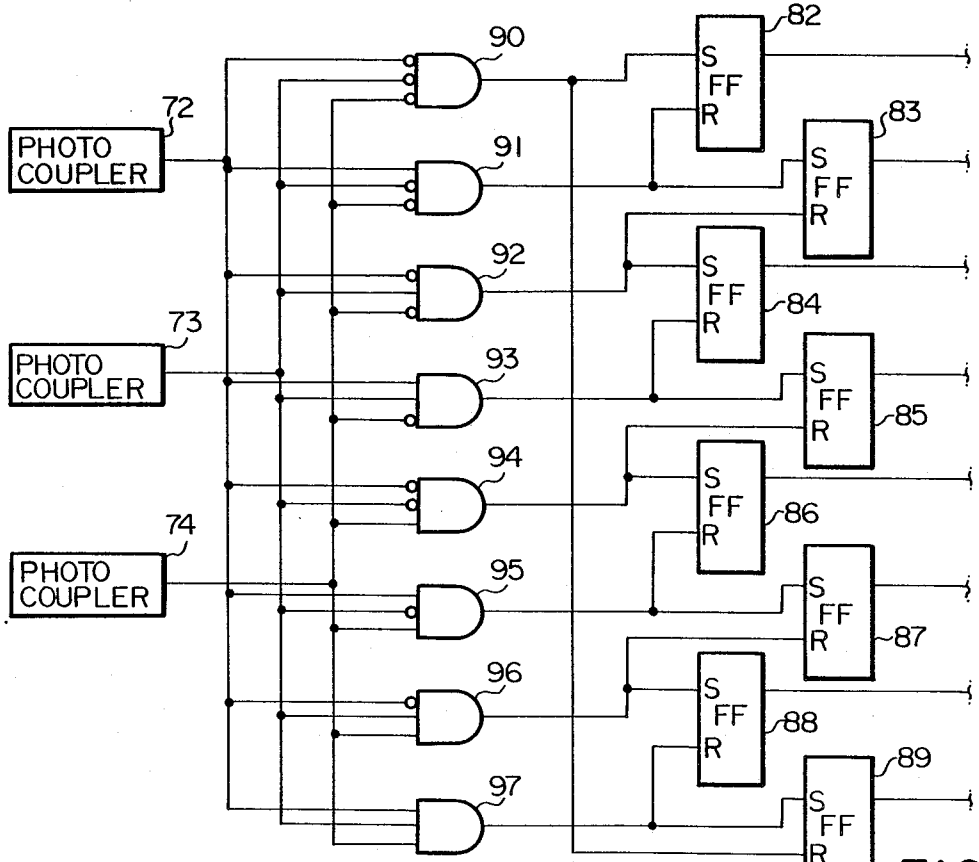
FIG. 16 is a block diagram showing the circuit arrangement of a signal processing circuit associated with the sensor unit with the encoder plate shown in FIG. 15.

Turning to FIG. 15 of the drawings, there is shown an encoder plate 71 incorporated in a sensor unit which in turn is provided in an automatic player piano embodying the present invention. The encoder plate 71 cooperates with three photo couplers 72, 73 and 74 which are accompanied with a signal processing circuit illustrated in FIG. 16. However, the other components are similar to those of the automatic player piano shown in FIG. 8, so that the corresponding components are referred to with like reference numerals, however, no detailed description is made.

The encoder plate 71 has a plurality of windows 75 to 81 arranged in three lines, All of the windows 75 to 81 are equal in width to one another. However, the windows in each line are different in height from the windows in another line. Namely, the windows 75 to 78 are equal in height to one another but different from the other windows 79 to 81. Similarly, the window 79 is equal in height to the window 80 but different from another window. The windows in the respective lines intermittingly pass the optical paths of the photo couplers 72, 73 and 74, respectively, and the three photo couplers 72 to 74 are arranged in a juxtaposed manner, so that three bits of an encoder signal is produced by the photo couplers 72 to 74 when the key 26 is moved from the undepressed state toward the depressed state. This results in that the controller 37 can discriminate eight positions on the locus of the key motion from one another.

The three bit encoder signal is supplied from the photo couplers 72, 73 and 74 to the signal processing circuit, and the signal processing circuit largely comprises eight flip flop circuits 82 to 89 ( each of which is abbreviated as "FF" in FIG. 16 ) and eight AND gates 90 to 97 which are of the three input node type. The three input nodes of each AND gate are selectively accompanied with an inverter circuit or inverter circuits ( which are indicated by small bubbles ), and, for this reason, the AND gates 90 to 97 sequentially produces output signals. The output signals of the AND gates 90 to 97 are respectively supplied to the set nodes of the flip flop circuits 82 to 89, however, the reset nodes of the flip flop circuits 2 to 89 are supplied with the output signals of the adjacent AND gates 91 to 90, respectively. The flip flop circuits 82 to 89 thus arranged are sequentially shifted to the set states and, accordingly, produces an eight bit position signal. The bit string of the position signal is varied by advancement of the key 26, so that the micro-computer unit 41 can trace the locus of the key motion with the variation of the bit string.

Fourth embodiment

Figure 17:
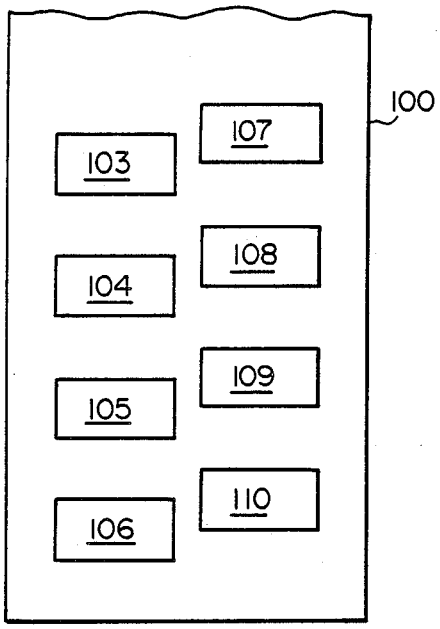
FIG. 17 is a plan view showing still another encoder plate used in still another automatic player piano embodying the present invention.
Figure 18:
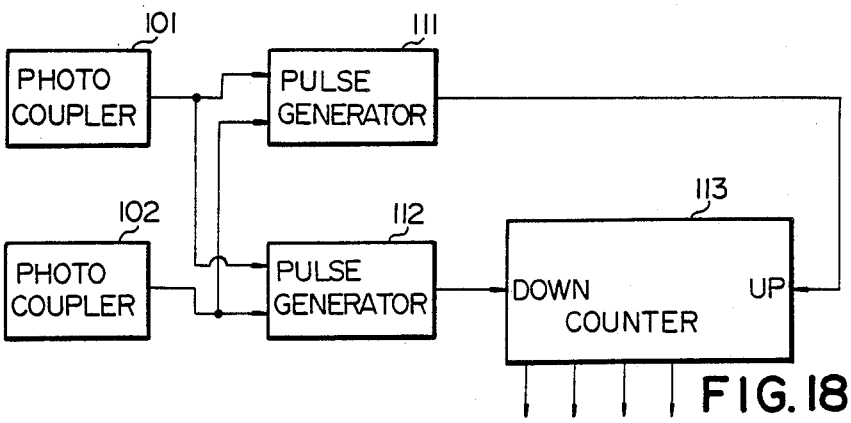
FIG. 18 is a block diagram showing the circuit arrangement of a signal processing circuit incorporated in the automatic player piano with the encoder plate shown in FIG. 17.
Figure 19:
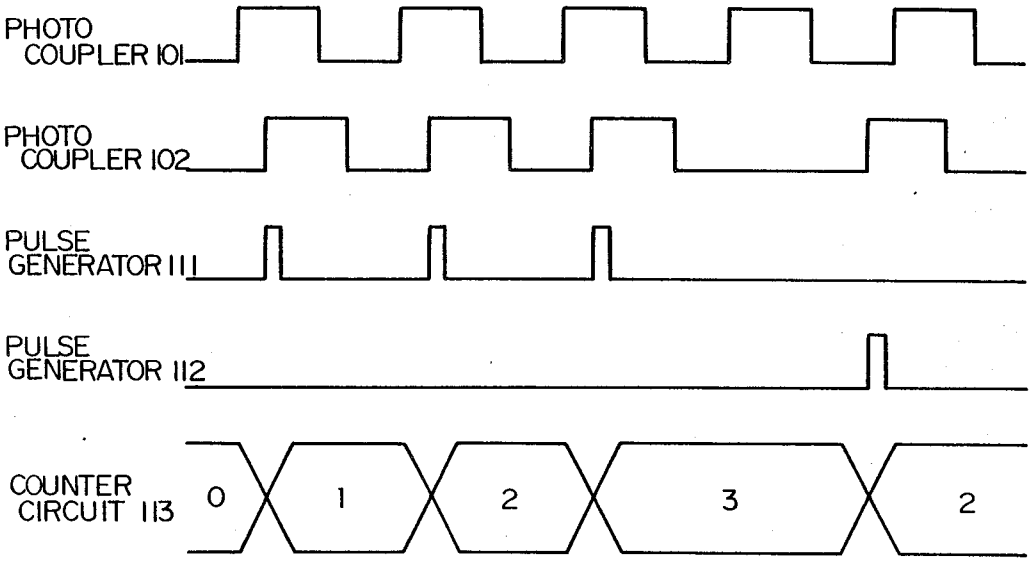
FIG. 19 is a diagram showing waveforms of essential signals produced in the signal processing circuit shown in FIG. 18.

Turning to FIG. 17 of the drawings, still another encoder plate 100 is illustrated. The encoder plate 100 is provided in association with two photo couplers 101 and 102 and, accordingly, formed with two lines of windows 103 to 110. All of the windows 103 to 110 are identical in shape with one another and spaced at a regular interval, however, these windows are arranged in a staggered manner. The photo couplers 101 and 102 are respectively coupled to both pulse generators 111 and 112 as shown in FIG. 18, and the count pulses produced by the generators 111 and 112 are supplied to the count-up node and the count-down node of a counter circuit 113, respectively. The signal processing circuit thus arranged is operative to increment or decrement the counting value which is indicative of discrete positions on the locus of the key motion. Since the windows 103 to 106 are arranged in the staggered manner with respect to the windows 107 to 110, the pulse generator 111 produces the clock pulses on the way to the depressed state, however, the pulse generator 112 keeps silent, so that the counter circuit 113 increments the counting value with time. On the other hand, when the key is released, the pulse generator 112 produces the clock pulses, however, the no clock pulse is supplied to the count-up node of the counter circuit 113, then the counter circuit 113 decrements the value. Thus, the counting value is incremented or decremented depending upon the direction of the key motion. Then, the micro-computer unit 41 can trace the locus of the key motion with the output signal of the counter circuit 113 as will be understood from the waveforms in FIG. 19.

Although particular embodiment of the present invention have been shown and described, it will be obvious to those skilled in the art that various changes and modifications may be made without departing from the spirit and scope of the present invention. For example, the actomatic player system according to the present invention is applicable to a mechanical piano of the grand type.

What is claimed is:

1. An automatic player piano operable in a recording mode of operation and a playback mode of operation, comprising:

(a) a mechanical piano having (a-1) a keyboard mounted on a key bed and provided with a plurality of keys respectively depressed with forces by a player, (a-2) a key action mechanism coupled to said keyboard for transmitting the forces exerted on said keys, (a-3) a hammer mechanism provided with a plurality of hammer assemblies, said hammer assemblies being coupled to said key action mechanism and driven for rotations with the forces transmitted by said key action mechanism, and (a-4) a plurality of music wires respectively struck with said hammer assemblies for producing sounds; and (b) an automatic player system having (b-1) a controller operative to memorize pieces of key touch information respectively representative of grades of intensity assigned to said sounds in said recording mode of operation and retrieve the pieces of the key touch information in said playback mode of operation, (b-2) a plurality of actuators provided in association with said keyboard and responsive to the pieces of said key touch information for causing said keys to move, and (b-3) a sensor unit provided between said key bed and said keyboard and operative to detect key motions of said keys for producing the pieces of said key touch information in said recording mode of operation, in which each of the pieces of said key touch information is estimated on the basis of each of said key motions.

2. An automatic player piano as set forth in claim 1, in which said automatic player system further comprises tracing means operative to produce loci of said key motions, sampling means operative to extract sections for uniform motions from said loci, respectively, key velocity calculating means operative to decide key velocities in said sections, respectively, final hammer velocity deciding means operative to estimate final velocities of said hammer assemblies on the basis of said key velocities, respectively, and key touch information producing means operative to produce the pieces of said key touch information on the basis of said final velocities, respectively.

3. An automatic player piano as set forth in claim 2, in which said controller is further associated with said sensor unit to produce pieces of a note information representative of notes assigned said keys depressed by said player.

4. An automatic player piano as set forth in claim 3, in which the pieces of said note information are memorized in said controller in said recording mode of operation and retrieved in said playback mode of operation for selective actuations of said actuators.

5. An automatic player piano as set forth in claim 4, in which said actuators are of the solenoid-operated type.

6. An automatic player piano as set forth in claim 4, in which said automatic player piano further comprises pedals for a music expressiveness, sensors operative to produce pieces of a pedal information representative of operations by said player in said recording mode of operation for memorizing into said controller, and actuators provided in association with said pedals and responsive to the pieces of said pedal information for selective actuations of the pedals.

7. An automatic player piano as set forth in claim 2, in which said sensors unit comprises a plurality of encoder plates respectively coupled to said keys, and plural groups of photo couplers, each group producing a plurality of optical paths intermittingly blocked by said encoder plate.

8. An automatic player piano as set forth in claim 7, in which each of said encoder plates is formed with a plurality of windows equal in number to the photo couplers of each group.

9. An automatic player piano as set forth in claim 8, in which said windows are deviated from one another and in which the photo couplers of each group are provided on a virtual plane perpendicular to the loci of said key motions.

10. An automatic player piano as set forth in claim 9, in which said windows are arranged in lines equal in number to the photo couplers of each group and in which windows in each line are equal in height to one another but different from the windows in another line.

11. A key touch estimation system provided in association with a mechanical piano having a keyboard provided with a plurality of keys respectively depressed with forces by a player, a key action mechanism coupled to said keyboard for transmitting the forces exerted on said keys, a hammer mechanism provided with a plurality of hammer assemblies, said hammer assemblies being coupled to said key action mechanism and driven for rotations with the forces transmitted by said key action mechanism, and a plurality of music wires respectively struck with said hammer assemblies for producing sounds, said key touch estimation system comprising (a) a controller operative to memorize pieces of key touch information respectively representative of grades of intensity assigned to said sounds in said recording mode of operation and retrieve the pieces of the key touch information in said playback mode of operation, (b) a plurality of actuators provided in association with said keyboard and responsive to the pieces of said key touch information for causing said keys to move, (c) a sensor unit provided in association with said keyboard and operative to detect key motion of said keys for producing the pieces of said key touch information in said recording mode of operation, (d) tracing means operative produce loci of said key motions, (e) sampling means operative to extract sections for uniform motions from said loci, respectively, (f) key velocity calculating means operative to decide key velocities in said sections, respectively, (g) final hammer velocity deciding means operative to estimate final velocities of said hammer assemblies on the basis of said key velocities, respectively, and (h) key touch information producing means operative to produce the pieces of said key touch information on the basis of said final velocities, respectively.

* * * * *